US009982397B2

(12) United States Patent
Korb et al.

(10) Patent No.: US 9,982,397 B2
(45) Date of Patent: May 29, 2018

(54) METHOD FOR PLANNING AND IMPLEMENTATION OF SOIL COMPACTING PROCESSES, ESPECIALLY FOR ASPHALT COMPACTING

(71) Applicant: HAMM AG, Tirschenreuth (DE)

(72) Inventors: Christoph Korb, Wiesau (DE); Matthias Meier, Tirschenreuth (DE)

(73) Assignee: HAMM AG, Tirschenreuth (DE)

( * ) Notice: Subject to any disclaimer, the term of this patent is extended or adjusted under 35 U.S.C. 154(b) by 113 days.

(21) Appl. No.: 14/403,453

(22) PCT Filed: Dec. 11, 2012

(86) PCT No.: PCT/EP2012/075041

§ 371 (c)(1),
(2) Date: Nov. 24, 2014

(87) PCT Pub. No.: WO2013/174458

PCT Pub. Date: Nov. 28, 2013

(65) Prior Publication Data

US 2015/0167257 A1 Jun. 18, 2015

(30) Foreign Application Priority Data

May 22, 2012 (DE) ..... 10 2012 208 554

(51) Int. Cl.
*E01C 19/00* (2006.01)
*E02D 3/02* (2006.01)
(Continued)

(52) U.S. Cl.
CPC ..... *E01C 19/004* (2013.01); *E01C 7/36* (2013.01); *E01C 19/23* (2013.01); *E01C 19/266* (2013.01); *E02D 3/02* (2013.01)

(58) Field of Classification Search
CPC ..... E01C 19/004; E01C 19/23; E01C 19/266; E01C 19/22; E01C 19/00; E01C 19/238;
(Continued)

(56) References Cited

U.S. PATENT DOCUMENTS 5,471,391 A 11/1995 Gudat et al.
5,493,494 A 2/1996 Henderson
(Continued)

FOREIGN PATENT DOCUMENTS

DE 69501401 T2 8/1998
DE 694 16 006 T2 8/1999
(Continued)

OTHER PUBLICATIONS

Office Action issued for European Patent Application No. 12610150.6 dated Dec. 8, 2015 with machine English translation (9 pages).
(Continued)

*Primary Examiner* — Abigail A Risic
(74) *Attorney, Agent, or Firm* — Prince Lobel Tye, LLP

(57) ABSTRACT

A method for planning and implementation of soil compacting processes using at least one soil compactor resulting in an efficient use of compactors and an improved compacting result. Under the method, a base region (B) to be compacted is defined, the relevant aspects of a soil compacting process are planned, and only then is the process implemented by moving at least compactor in the base region (B), according to the plan. The plan for the soil compacting process may include the quantity and course of compactor passes in the base region.

17 Claims, 5 Drawing Sheets

(51) Int. Cl.

| | |
|---|---|
| ***E01C 7/36*** | (2006.01) |
| ***E01C 19/23*** | (2006.01) |
| ***E01C 19/26*** | (2006.01) |

(58) Field of Classification Search
CPC ..... E01C 19/264; E01C 19/288; E01C 7/36; E02D 3/026; E02D 3/02; E02D 1/022
See application file for complete search history.

(56) References Cited

U.S. PATENT DOCUMENTS

| | | | | |
|---|---|---|---|---|
| 6,088,644 | A * | 7/2000 | Brandt | E01C 19/004 172/4.5 |
| 6,112,143 | A * | 8/2000 | Allen | E01C 19/006 342/357.32 |
| 7,491,014 | B2 | 2/2009 | Sick | |
| 7,873,492 | B2 | 1/2011 | Ackermann | |
| 8,116,950 | B2 | 2/2012 | Glee | |
| 2006/0193693 | A1 | 8/2006 | Congdon | |
| 2007/0025615 | A1 | 2/2007 | Sick | |
| 2007/0239338 | A1* | 10/2007 | Potts | E01C 19/288 701/50 |
| 2008/0063473 | A1* | 3/2008 | Congdon | E01C 19/288 404/75 |
| 2008/0260462 | A1 | 10/2008 | Ackermann | |
| 2009/0126953 | A1* | 5/2009 | Anderegg | E01C 19/288 172/1 |
| 2010/0087992 | A1 | 4/2010 | Glee | |
| 2011/0150572 | A1* | 6/2011 | Fritz | E01C 19/004 404/72 |
| 2012/0107045 | A1 | 5/2012 | Declerk et al. | |
| 2013/0136539 | A1* | 5/2013 | Aardema | G01K 1/024 404/75 |

FOREIGN PATENT DOCUMENTS

| | | | |
|---|---|---|---|
| DE | 199 83 437 | T1 | 8/2001 |
| DE | 103 17 160 | A1 | 11/2004 |
| DE | 10 2007 019 419 | A1 | 10/2008 |
| DE | 10 2008 058 481 | A1 | 7/2009 |
| EP | 0 761 666 | A1 | 3/1997 |
| EP | 0 761 886 | A1 | 3/1997 |
| EP | 0761886 | A1 | 3/1997 |
| EP | 1 985 761 | A2 | 10/2006 |
| EP | 1985761 | A2 | 10/2008 |
| WO | 00/10063 | A1 | 2/2000 |
| WO | 0010063 | A1 | 2/2000 |

OTHER PUBLICATIONS

Office Action issued for Chinese Patent Application No. 201280072909.7 dated Aug. 20, 2015.
International preliminary report on patentability and Written Opinion issued for International Application No. PCT/EP2012/075041 dated Nov. 25, 2014, (9 pages).
German search report issued for German patent application No. 10 2012 208 554.8 dated Mar. 7, 2013, with machine English translation (9 pages).
International Search Report Issued for International Application No. PCT/EP2012/075041 dated Feb. 20, 2013, 3 pages.
"Positionierungslösung für Straβenwalzen—Grundlage für eine kontinuierliche Qualitätskontrolle and Dokumentation der Verdichtungsarbeit im Asphaltbau," dissertation by Dipl.-Ing. Karl Ludwig Kley, Department of Civil Engineering, Geosciences and Environmental Sciences, University of Fridericiana, Karlsruhe (TH), Karlsruhe 2004 (76 pages).
Veeramani et al: "Computer-integrated collaborative design and operational in the construction industry", Automation in Construction 7 (1998), 485-492, Elsevier (8 pages).
Krishnamurthy et al: "AutoPave: towards an automated paving system for asphalt pavement compaction operations", Automation in Construction 8 (1998), 165-180, Elsevier (16 pages).
Tserng et al: "An Operations Planning System for Asphalt Pavement Compaction", Proceedings of the 13th ISARC, Tokyo, Japan, 1996, International Association for Automation and Robotics in Construction (10 pages).
Printout of the website of the International Association for Automation and Robotics in Construction with the table of contents of the Proceedings of the 13th ISARC, Tokyo, Japan, 1996 (17 pages).
Expression of the Wikipedia article "Richtlinien für die Anlage von Straβen—Querschnitt" (3 pages).
"Grundlagen der Asphaltverdichtung," rolling primer of the company BOMAG GmbH, 2009 (59 pages).
Kloubert, Wallrath "Intelligente Asphaltverdichtung" Gestrata Journal, Oct. 2010 (11 pages).
Brochüre "Tracked Paver Super 1800-2" from Joseph Vögele AG, Apr. 2010 (14 pages).
Opposition filed in corresponding European Patent Application No. 12810150.8 dated Jul. 12, 2017, with machine English translation (105 pages).

* cited by examiner

METHOD FOR PLANNING AND IMPLEMENTATION OF SOIL COMPACTING PROCESSES, ESPECIALLY FOR ASPHALT COMPACTING

CROSS REFERENCE TO RELATED APPLICATION

This application is a 35 U.S.C. 371 National Phase Entry Application from PCT/EP2012/075041, filed Dec. 11, 2012, which claims the benefit of German Patent Application No. 10 2012 208 554.8 filed on May 22, 2012, the disclosures of which are incorporated herein in their entirety by reference.

The present invention relates to a method for planning and implementation of compacting processes, especially for asphalt compacting, by means of at least one compactor.

In compacting and in preparation for compacting of soil surfaces, such as asphalted roads or the like, it is of fundamental importance that after application of the material for compacting, for example asphalt, using one or several compactors, a sequence of the compacting procedure is selected that is suitable for the quality of the compacted soil to be achieved, wherein this sequence firstly is defined by the number of passes by one or several compactors, and secondly by the position of the compacting paths selected for the particular passes. Too many passes over the material to be compacted can lead to excessive compaction, which can result in unevenness over a larger base region, especially in the case of irregular compacting. Similarly, an insufficient number of passes results in insufficient compaction of the material to be compacted, which adversely affects not only the quality of the finished material with respect to its structure, but also its smoothness.

From DE 10 2007 019 419 A1 a method is known for determining the degree of compaction of a base region. In this method, the already attained degree of compaction is deduced from various parameters determined during the compacting process. The base region to be compacted is rolled repeatedly until compaction reaches the desired level.

The object of the present invention is to specify a method for planning and implementation of soil compacting processes, especially for compacting asphalt, by means of at least one compactor, so that provided there is efficient use of compactors for soil compacting, an improved compacting result can be achieved.

According to the invention, this object is attained by a method for planning and implementation of compacting processes, especially for compacting asphalt, by means of at least one compactor, comprising the following steps:

a) Defining a base region (B) to be compacted,
b) Based on the base region (B) defined in step a), defining a compacting plan with a quantity and course of compactor passes in the base region,
c) Movement of at least one compactor (10) in the base region (B) defined in step a) according to the compacting plan defined in step b).

With the invented method, even before implementation of a compacting process, the relevant aspects of said process are planned and then implemented according to this plan, that is, the compacting plan. This will ensure that no unnecessarily large number of compactor passes is used, which on the one hand reduces the efficiency of overall processing, and on the other entails the problem of uncertain compaction of the material. By means of preceding planning it can be determined precisely where and how often one or several compactors must be moved over the base region to be compacted so as to attain the desired goal, namely a specified degree of compaction which is to be as consistent as possible over the surface to be compacted.

In order to be able to further enhance the efficiency of the inventive method and to further improve the compacting result, it is recommended that step a) also include defining at least one compactor to be employed for compacting of the base region and that in step b), the compacting plan be further defined on the basis of the at least one compactor to be employed for the compacting. With allowance for the compactor to be used, in preparation of the compacting plan it can be ensured that a desired degree of compaction can be obtained as quickly and as precisely as possible.

The at least one compactor to be used for compacting the base region can be selected from a group containing compactors that differs in at least one of the following parameters:

Compactor roller width,
Compactor weight,
Compacting mode,
Crab steering capability.

It should be pointed out here that the crab steering capability describes whether or to what extent two compactor rollers of a compactor can be offset with respect to each other transversely to the direction of motion of said compactor, so that a zone exists in which the two compactor rollers overlap, and each roller has a zone in which it extends laterally past the other roller.

The edge regions of the base region and/or at least one of these edge regions and/or the course thereof are of particular importance in defining the base region to be compacted or its geometric course. For example, this kind of edge region can form the starting basis for determining the sequence of compactor passes. It is therefore proposed that at least one edge region of the base region to be compacted be determined by a device, preferably an asphalt finisher, which is preferably moved along the base region to be compacted and prepares it. A device preparing the base region, for example an asphalt finisher, which applies the asphalt for compacting, moves precisely in that area where subsequently a compactor is to be moved to implement a compacting process. With the movement of this device, for example an asphalt finisher, it is thus easily possible to determine the course of at least one edge region and to use it for subsequent preparation of the compacting plan.

The base region to be compacted can be defined in terms of its edge region, so that ultimately the minimum or maximum number of adjacent compactor passes can be determined that are needed to completely or nearly completely and adequately frequently cover the base region. It is self-evident that the base region to be compacted can also be determined in terms of the material to be compacted, that is, asphalt or the like, for example, and its layering, or in terms of the degree of compaction desired in execution of the compaction process.

In rolling the base region to be compacted with one or several compactors, in order to ensure that the base region can be entirely covered and no areas are left in which the desired compacting target is not attained due to insufficient passes, it is proposed that in step b), the compacting plan be defined with at least one group of compactor passes, wherein at least one group of compactor passes comprises a plurality of adjacent compactor passes in the base region width direction, and wherein at least two, preferably all adjacent compactor passes have mutually overlapping compacting paths. Considering that during the forward movement of a compactor there is an unavoidable inaccuracy and/or imprecision with respect to the surface area actually rolled, the overlap between adjacent compacting paths will ensure that in fact every surface area can be covered. In particular the overlap should be selected advantageously such that it is at least as large as, and preferably larger, than the unavoidable imprecision in the forward movement of a compactor with respect to the surface areas actually covered.

The invention provides in a particularly advantageous manner that in at least one group of compactor passes, all adjacent compacting paths each have a substantially equal amount of overlap.

When several groups of compactor passes are needed to achieve the desired degree of compaction, to ensure that the overlaps present in the different groups between adjacent compacting paths do not lie one atop the other, thus that the overlapping areas of different groups can in fact be located in different surface areas of the base region to be compacted, it is proposed that for at least one group of compactor passes, the adjacent compacting paths have a different amount of overlap with respect to at least one other group of compactor passes.

Since in general a base region to be compacted is bordered by at least one edge region, for efficient implementation of the method it is proposed that for at least one group of compactor passes, at least one compacting path is defined substantially flush along an edge region of the base region to be compacted. The expression "substantially flush" is intended here to mean that the compacting path running along the edge region is positioned such that in the edge region, substantially no surface area remains in which the material being compacted is not covered by one compactor pass, but that care must still be taken that a compactor with its compactor roller(s) does not go unnecessarily far beyond the edge region into an area in which there is no more soil material to be compacted. However, if there is no curb present to demarcate the base region to be compacted, for example, and considering the unavoidable imprecision of forward movement of a compactor, some overhang can be defined in order to ensure that the entire base region to be compacted is covered.

To attain the most uniform possible compaction of the base region, it is proposed that for at least one group of compactor passes, one compacting path is defined that is substantially flush along a first edge region, and an additional compacting path is defined that is substantially flush along a second edge region of the base region to be compacted, and that for at least one group of compactor passes, a compacting path is defined that is substantially flush along the first edge region, and/or for at least one group of compactor passes, one compacting path is defined that is substantially flush along the second edge region.

At least some and preferably all compacting paths of at least one group of compactor passes, preferably substantially all compactor passes, can be executed such that they run substantially in the direction of a base region longitudinal direction, which can, for example, be substantially orthogonal to the base region width direction.

For efficient implementation of the inventive method, assuring uniform compaction, it is proposed that in step b) the minimum number of compactor passes is determined on the basis of the width of the base region, the width of the compactor roller, and a minimum amount of overlap of adjacent compacting paths. The minimum number of compactor passes can be determined such that the following relation is satisfied:

$$BB-(VWB-MÜA)\leq n\times VWB-(n-1)\times MÜA-GÜST\leq BB,$$

Wherein:

n is the minimum number of compactor passes and is a whole integer,

BB is the width of the base region,

VWB is the width of the compactor roller,

MÜA is the minimum amount of overlap,

GÜST is the total edge overhang.

This takes into account that for a given number of compactor passes, the overlap areas produced between these adjacent passes and/or their compacting paths are 1 less than the number of compacting paths, and that in addition a remaining surface area not covered by a compacting path is smaller than the width of the compactor roller(s) used for the compacting. Of course, here too it can also be taken into account that when one of the compacting paths is defined along an edge region, this compacting path can be located to the side, with a defined overhang extending beyond the edge region in order to ensure that the edge region is also entirely covered.

In addition, for efficient implementation of the method, it is proposed that in step b) the maximum number of compactor passes be determined on the basis of the width of the base region, the width of the compactor roller, and a minimum amount of overlap of adjacent compacting paths, wherein the maximum compactor pass number can be determined such that the following relation is satisfied:

$$BB\leq N\times VWB-(N-1)\times MÜA-GÜST\leq BB+VWB,$$

Wherein:

N is the maximum number of compactor passes and is a whole integer

BB is the width of the base region,

VWB is the width of the compactor roller,

MÜA is the minimum amount of overlap,

GÜST is the total edge overhang.

In particular this procedure takes into account that when adjacent compacting paths overlap to an extent corresponding to the minimum amount of overlap, due to the actually provided compacting paths, the entire base region is substantially covered in the base region width direction, wherein in both edge regions each overhang of the specifically defined compacting path can also be taken into account.

Preferably the maximum number of compactor passes and the minimum number of compactor passes differ by 1, so that in general the following relation applies:

$$N=n+1.$$

In particular when the entire base region is to be covered by one group of compactor passes in the base region width direction, in order to attain a uniform distribution of the compacting paths, it is proposed that for one group of compactor passes with a maximum compactor pass quantity, one compacting path is defined substantially flush along a first edge region and an additional compacting path is defined substantially flush along a second edge region of the base region to be compacted, and that the amount of overlap of adjacent compacting paths of this group of compactor passes is determined such that essentially the following relation applies:

$$BB+GÜST=N\times VWB-(N-1)\times ÜA,$$

Wherein:

ÜA is the amount of overlap,

GÜST is the total edge overhang.

Here also it can be taken into account that in one or both edge regions, the compacting path defined there can extend laterally beyond the edge region, wherein the parameter BB must then be added to the total amount of overhang in the two edge regions. The result of this is that any remaining or available overlap of individual compacting paths is smaller than when no overhang is present in one or possibly both edge regions.

In the procedure according to the invention, at least one compactor pass, preferably all compactor passes, can be defined such that movement of at least one compactor for compacting the base region is forward in a first movement direction and backward in a second movement direction, opposite to the first movement direction.

With a compactor pass defined in this manner, when preparing the compacting plan it must be taken into account that in a compactor pass, the rolled surface area of the base region being compacted is compacted two times by the compactor. For example, if a compactor has two compactor rollers arranged in series in its direction of forward movement, then this means that in one compactor pass, compaction will be by a total of four roller passes. Quite obviously it is also possible to define a compactor pass differently. For instance, every individual roller pass could be interpreted as a compactor pass. If a compactor has two compacting rollers and if it moves once forward and once backward along a compacting path in the base region to be compacted, this means that with this definition of a compactor pass, a total of four compactor passes are executed.

The present invention will be described in detail below with reference to the attached figures. Wherein.

Figure 1:
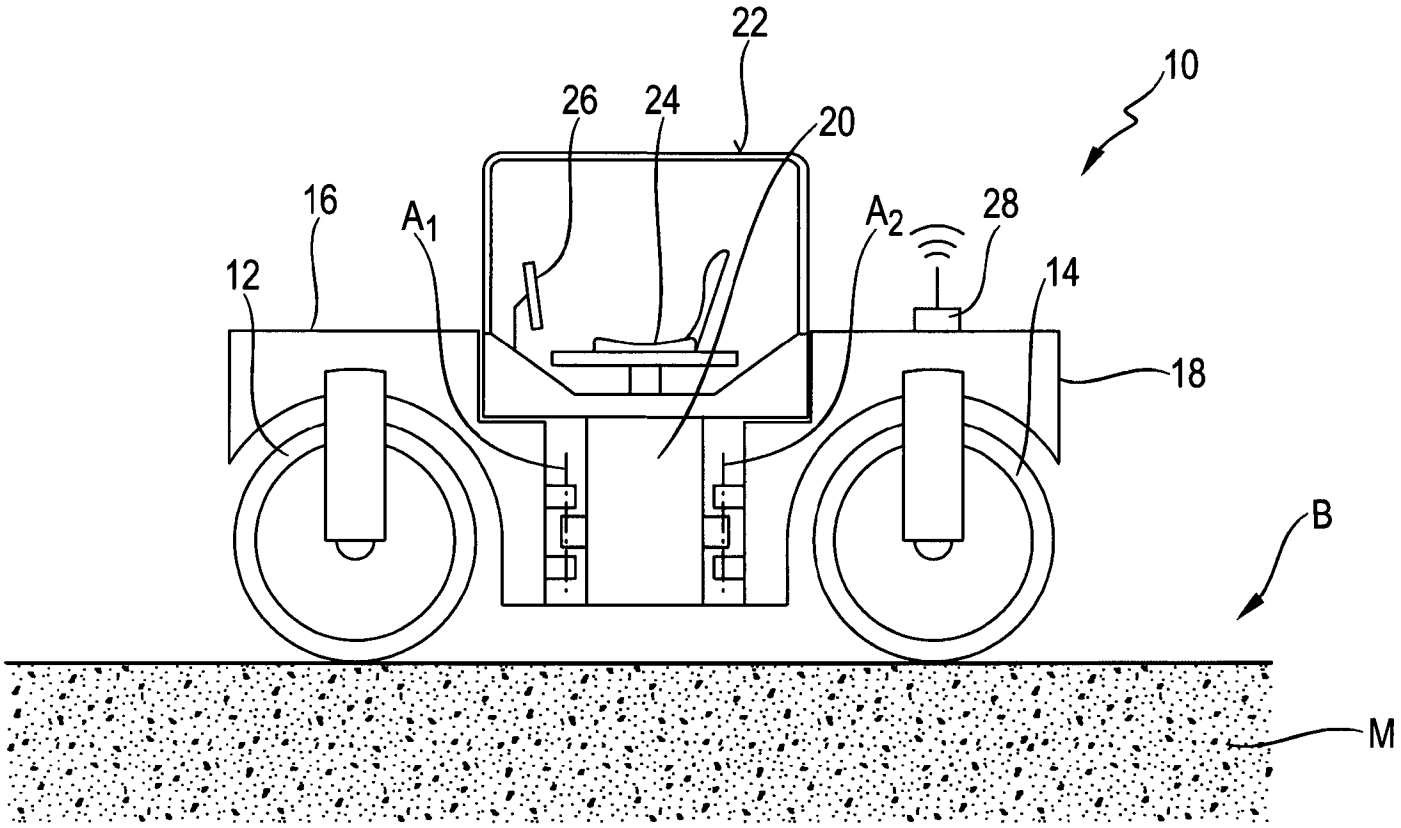
FIG. 1 is basically a side view of a compactor with two compactor rollers.

FIG. 1 shows a basic representation and side view of a compactor represented in general by reference number 10, which is moving along a base region B to be compacted, in order to compact the soil material M of the base region B in one or several compactor passes. This material B can be, for example, asphalt material used in road construction, which is applied with an asphalting machine in one or several layers in a flowable state and is to be compacted by one or several compactors 10 before it fully hardens.

The compactor 10 in the illustrated example comprises two compactor rollers 12, 14, generally also termed drums. The compactor roller 12 is mounted on a front compactor frame 16 in a rotatable manner and can also be driven to rotate. Compactor roller 14 is mounted on a front compactor frame 18 in a rotatable manner and can also be driven to rotate. The front frame 16 and the rear frame 18 are mounted on a middle frame 20 so as to be pivotable about vertical axes $A_1$ and $A_2$ by means of a pivot drive (not shown). First of all this allows directional control, and secondly allows the use of so-called crab steering. In this regard, the front roller 12 and the rear roller 14 are turned in the side direction, that is, offset with respect to one another orthogonally to the plane of the illustration in FIG. 1, but still with an approximately parallel roller axis of rotation. In this crab steering, therefore, the surface area of the base region to be compacted and covered in the forward movement of the compactor 10 is enlarged, wherein a partial area of this covered surface area is rolled by two compactor rollers 12, 14, whereas on both sides there are partial areas that are covered or rolled by only one of the two compactor rollers 12, 14. It should be pointed out that quite obviously this adjustability of the crab steering can also be attained by a different design of the compactor. For instance, the entire compactor frame can be intrinsically rigid and the pivot drive for the two compactor rollers 12, 14 can be implemented by vertical pivot axes where the rollers are attached to the intrinsically rigid compactor frame.

A driver's cab denoted by reference number 22 is provided on the middle compactor frame 20 with a seat 24 and a display 26. Via the display 26, information relevant to the compacting process can be displayed for the operator seated on the seat 24.

By means of a radio unit denoted in general by reference number 28, the compactor 10 can send information to and/or receive information from a central station or another compactor. Furthermore, the radio unit 28 can also be designed as a GPS unit and in this manner can receive information about the positioning of the compactor 10 in space.

It should be pointed out here that when implementing a compacting process, even differently configured compactors can be employed. For example, they can be designed without the crab steering feature. The compactors can also differ in the number of compacting rollers used, and if a compactor has only one compactor roller, it can in general have wheels in the rear area of the frame for propulsion. Compactors can also differ in the width of the one or several compacting rollers, likewise also in the compactor weight or weight distribution on the two rollers.

One essential aspect in which these compactors may differ is the compaction modes that they can use. This includes various physical aspects in addition to the surface load applied by the intrinsic weight, by which the compacting result attained by a compactor pass can be affected or adjusted. One such compacting mode, for example, is the vibration mode in which a vibration mechanism located in one particular compactor roller causes the compactor roller to perform an oscillating movement essentially in the vertical direction. Another compacting mode can comprise an oscillation operation in which a compactor roller is driven by an oscillation drive to perform an oscillating movement in the circumferential direction about its roller axis of rotation. Of course, these different operating modes can also differ in their particular oscillation frequency or amplitude. In this context it is basically also possible to provide an oscillation mode and a vibration mode in one and the same compactor roller. The compacting modes can also include a static compacting mode, that is, rolling with one or more compactor rollers without additional generation of oscillating movements. In this regard it should be pointed out that the expression Global Positioning System (GPS) here represents a plurality of different, generally satellite-based systems which allow real-time determination of the position of a device equipped with one such unit, that is for example, a compactor or an asphalt finisher or similar equipment, and accordingly to provide the data representing this position or the motion sequence, or to use such data to control forward movement, for example. In this regard it is also possible, in particular, to interpret several grouped rubber wheels, possibly offset or overlapping one other, in their entirety as one or several compactor rollers.

With the use of one or several compactors, for example, as illustrated in FIG. 1, a base region B and/or the material M located therein, asphalt for example, as depicted in the top view in FIG. 2, can be compacted by means of the procedure described below. First, the base region B to be compacted is defined with respect to various parameters. One important parameter is the width of the base region BB. Also, the length of the base region BL plays a substantial role, especially in the compacting of asphalt material, since it is an important determining factor for the surface of the base region to be compacted and it must be taken into account that the compacting process must be essentially completed before the compacting material reaches a state, for example due to cooling, in which additional compacting is virtually no longer possible. Depending on the area to be compacted, that is, depending on the length of base region BL and the width of the base region BB, a decision can be made about how many compactors are to be used to implement a compacting process and how quickly these must be driven forward. Also, the selection of the compactor to be used is governed by the various compacting modes, the compactor weight, and/or the compactor roller width, and of course also by the crab steering feature.

When selecting the compactor(s) to be used, in general the structure of the material M to be compacted also has to be taken into account, or the compacting result desired after completion of the compacting process. In particular in road construction, an asphalt model can be prepared, in a known manner, in which the desired degree of compaction can be specified with allowance for asphalt layering. With allowance for this desired degree of compaction, one or several employed compactors can be selected from among a group of compactors which differ in at least one of the parameters specified and mentioned above. When selecting several compactors from the group, of course compactors having the same design can also be used. This means that in the group of fundamentally different compactors, several compactors of the same type can also be grouped together. In addition, with allowance for this asphalt model or a model in general which represents the compacting result, it can be specified how many passes are needed with the selected compactor(s) in order to achieve the desired degree of compaction.

Based on these criteria, that is, the criteria which, on the one hand, define the base region to be compacted, for example in terms of its geometric characteristics and the desired compacting success, and on the other, based on the selected compactor(s) and/or their design, are used to devise a compacting plan that specifies how the compactor(s) are to move in the base region being compacted in order to ensure that the desired success, namely a particular degree of compaction, can be attained. This preparation of a compacting plan is described in detail below with reference to FIGS. 3 to 5.

Figure 3:
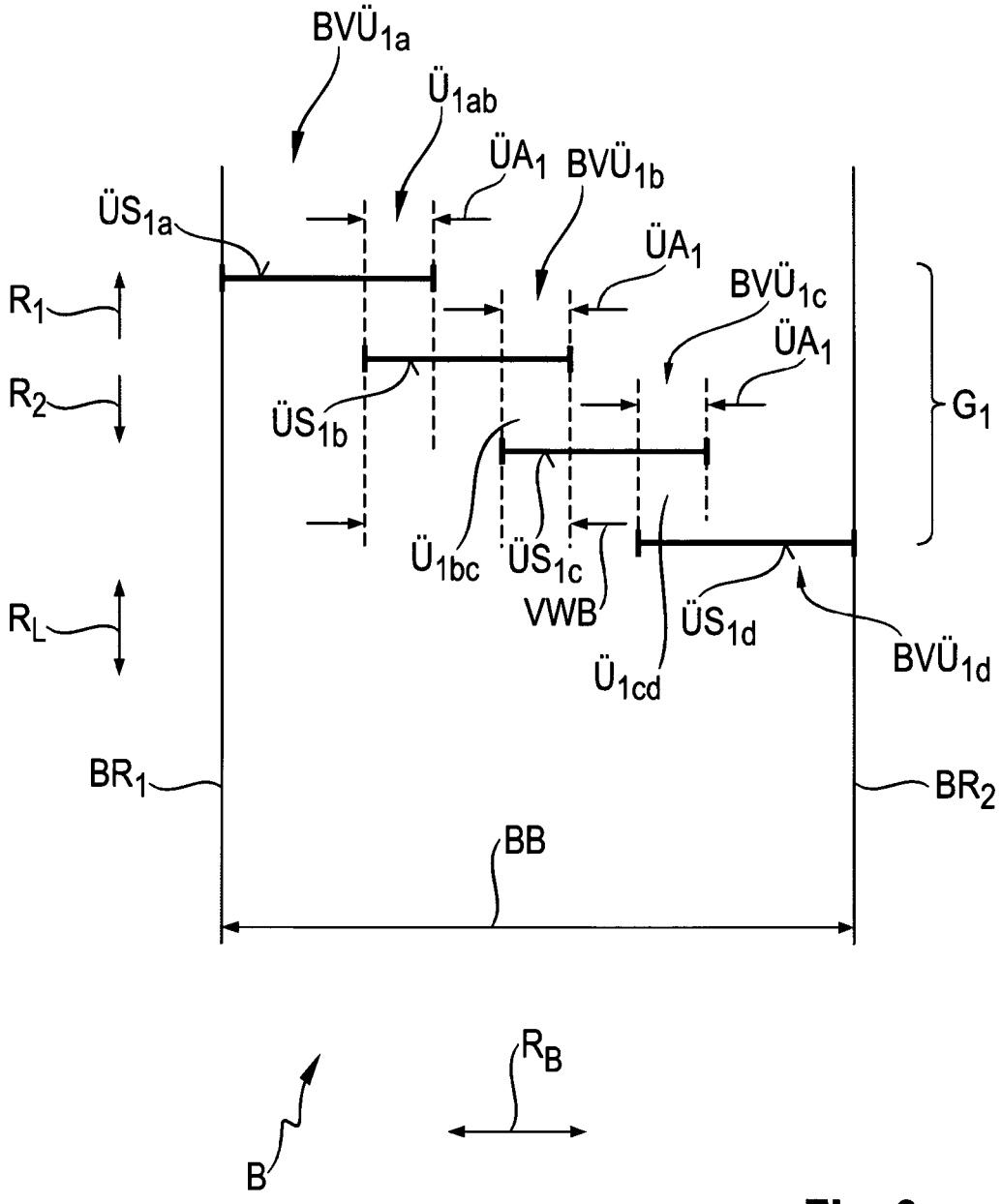
FIG. 3 is an example of a group of compactor passes with mutually overlapping compacting paths that cover the base region to be compacted over its entire width.

FIG. 3 shows a basic representation of the base region B to be compacted, which features the two edge regions $BR_1$ and $BR_2$ extending in the base region longitudinal direction $R_L$, that is to say, the edge regions of a road under construction. Between these two edge regions $BR_1$ and $BR_2$ the base region B extends by its base region width BB, wherein a base region width direction $R_B$ runs, for example, essentially orthogonally to the base region longitudinal direction $R_L$.

Figure 2:
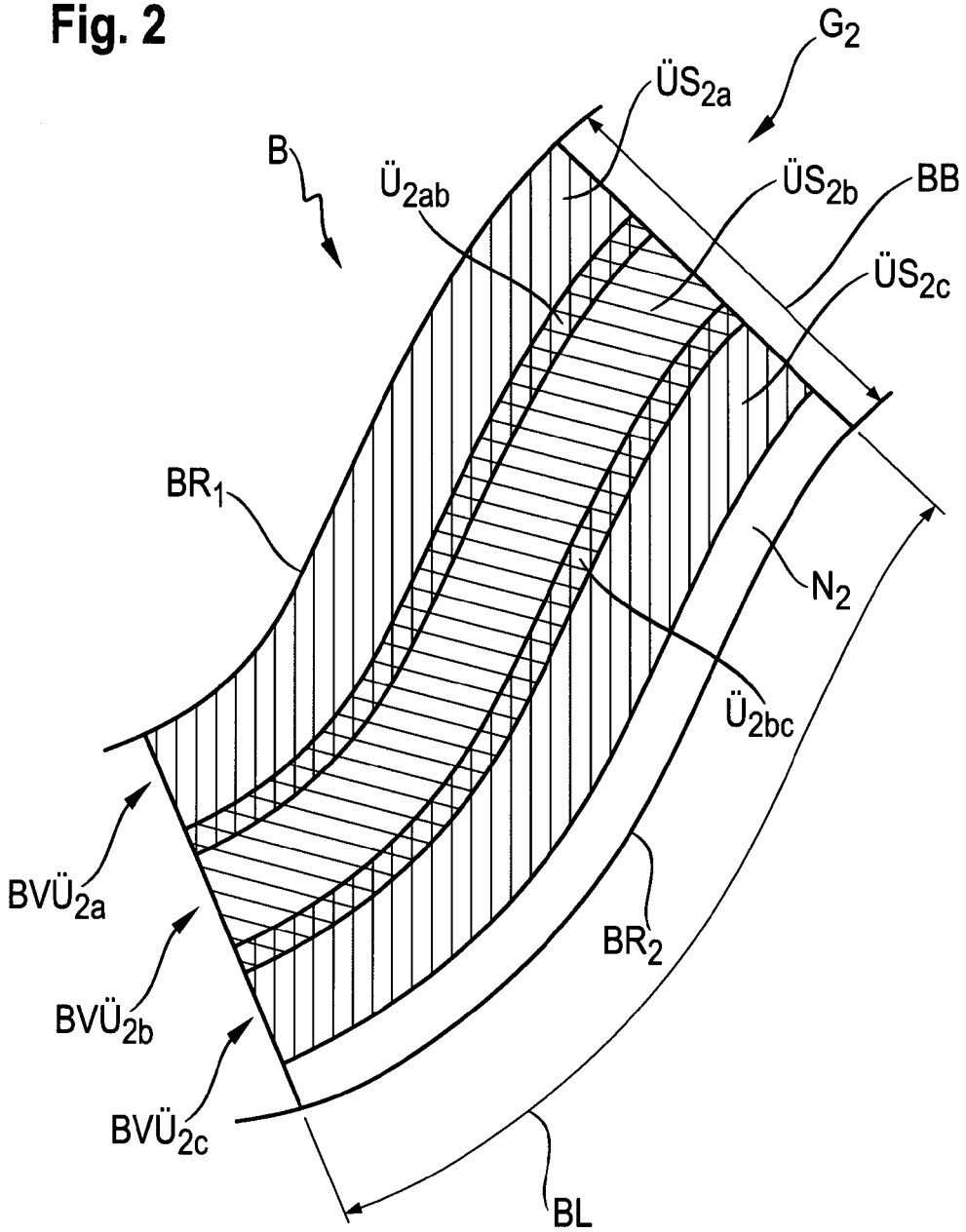
FIG. 2 is a top view of a base region to be compacted, with three mutually overlapping compacting paths.

The course of the base region B to be compacted in the base region longitudinal direction $R_L$, which is indicated primarily also in FIG. 2, is fundamentally determined by the course of the two edge regions $BR_1$ and $BR_2$. Therefore, to prepare the compacting plan in the manner described below, it can be advantageous to first define these edge regions $BR_1$ and $BR_2$ with respect to their course and also their particular end in the base region longitudinal direction $R_L$. This can be done, for example, based on mapping information generated by means of a survey, which contains the course of the base region to be compacted, for example, for a road under construction. In an alternative procedure, the course of the edge regions $BR_1$ and $BR_2$ and/or the course of at least one of these two edge regions $BR_1$ and $BR_2$ can be determined in a work step preceding a compaction process. In this regard a device can be used which moves in such a preceding work step in the base region B to be subsequently compacted. In preparation of a road, for example, an asphalt finisher can be used which applies asphalt material onto the base region B for subsequent compaction. By means of the two lateral end regions of the asphalt finisher and/or of the asphalt mat applied thereon, the edge regions $BR_1$, $BR_2$ can be defined. Thus it is possible, for example, to provide one or several GPS units on at least one side area of said device or asphalt finisher at a position which essentially coincides with the side edge of an applied asphalt layer. During the advance of this device, these GPS units can detect the spatial position of the side edge of the applied asphalt layer and thus also the position in space of the particular edge regions $BR_1$ and $BR_2$ of the base region B to be compacted. These data can be transmitted to a unit which prepares a compacting plan, for example to a central processing unit, and can be used there to define the edge regions $BR_1$, $BR_2$ and thus also to define the base region B to be compacted.

If the total width of the base region B to be compacted, that is, the lateral separation of the two edge regions $BR_1$ and $BR_2$, exceeds the working width of one such device, that is for example, an asphalt finisher, then at the two side areas of this device, GPS units can be provided which detect the assigned edge region $BR_1$ and/or $BR_2$ so that in a prior movement step, both edge regions $BR_1$, $BR_2$ are detected and/or the data defining their position in space are determined and can be processed for preparation of the compacting plan. Alternatively, it is also possible to detect by measurement only the position of a single edge region and then to calculate the location of the other edge region by using knowledge of the width of the base region B. In particular when the base region B is so wide that prior processing is not possible with a single device, such as with a single asphalt finisher, then several such finishers can be operated side by side, at somewhat of an offset in the production direction, in order to apply several asphalt layers which in their totality define the base region B to be compacted. Then the GPS units detecting the two edge regions $BR_1$, $BR_2$ can be located on each of the different devices moving along the particular edge region.

In particular when preparing the base region B for compacting with several devices, asphalt finishers for example, the total base region processed by all these devices can be used in its totality as the base region B to be compacted in order to prepare the compacting plan, especially when using the edge regions bordering this total region. Alternatively, it is possible to define a separate base region B, with particular edge regions $BR_1$ and $BR_2$ to be allocated to each of the individual devices, wherein several such base regions B, each to be provided with its own compaction plan, can lie next to one another, and then the edge region $BR_1$ of the one base region B will substantially correspond to the edge region $BR_2$ of the adjacent base region B.

To prepare a compacting plan, for example a first group $G_1$ of compactor passes BVÜ can be defined. Each compactor pass BVÜ is assigned to a compacting path ÜS, along which a compactor 10 such as that illustrated for example in FIG. 1 moves in a particular compactor pass BVÜ. For example, according to definition, in a compactor pass BVÜ the base region compactor 10 moves forward once in a first movement direction $R_1$ and once back in an opposing, second movement direction $R_2$. In each compactor pass BVÜ, in this definition of a compactor pass BVÜ, the compactor 10 thus moves twice along the intended compacting path ÜS, so that when using the compactor 10 illustrated in FIG. 1, the result is that the surface area covered by a particular compacting path ÜS is rolled four times by a compacting roller, namely twice by the compacting roller 12 and twice by the compacting roller 14.

The first group $G_1$ of compactor passes BVÜ illustrated in FIG. 3 thus combines a total of four compactor passes $BVÜ_{1a}$, $BVÜ_{1b}$, $BVÜ_{1c}$, and $BVÜ_{1d}$ located at an offset to each other in the base region width direction $R_B$, and each with compacting paths $ÜS_{1a}$, $ÜS_{1b}$, $ÜS_{1c}$ and $ÜS_{1d}$. In this context each compacting path ÜS corresponds to a width of the compactor roller area VWB of the compactor roller 12 or 14 moving along the base region B.

From FIG. 3 it is evident that in the first group $G_1$ of compactor passes BVÜ, one compacting path $ÜS_{1a}$ or $ÜS_{1d}$ is defined for each of the edge regions $BR_1$ and/or $BR_2$. Here a particular side edge of the compactor roller 12 or 14 can be controlled such that it is defined approximately exactly along the edge region $BR_1$ or $BR_2$. Also, some overhang can be provided to ensure that, allowing for unavoidable imprecision during movement of the compactor 10, no surface area is produced in which the material M is not, or is not sufficiently, compacted at any particular edge region $BR_1$ or $BR_2$.

It is further evident that the compacting paths $ÜS_{1a}$ to $ÜS_{1d}$ are placed so that adjacent compacting paths ÜS overlap each other with a certain amount of overlap $ÜA_1$. This amount of overlap $ÜA_1$ is the same for all three of the overlap areas $Ü_{1ab}$, $Ü_{1bc}$, and $U_{1cd}$ here between adjacent compacting paths ÜS, so that a uniform distribution of the compacting paths ÜS is obtained in the base region width direction $R_B$.

Figure 4:
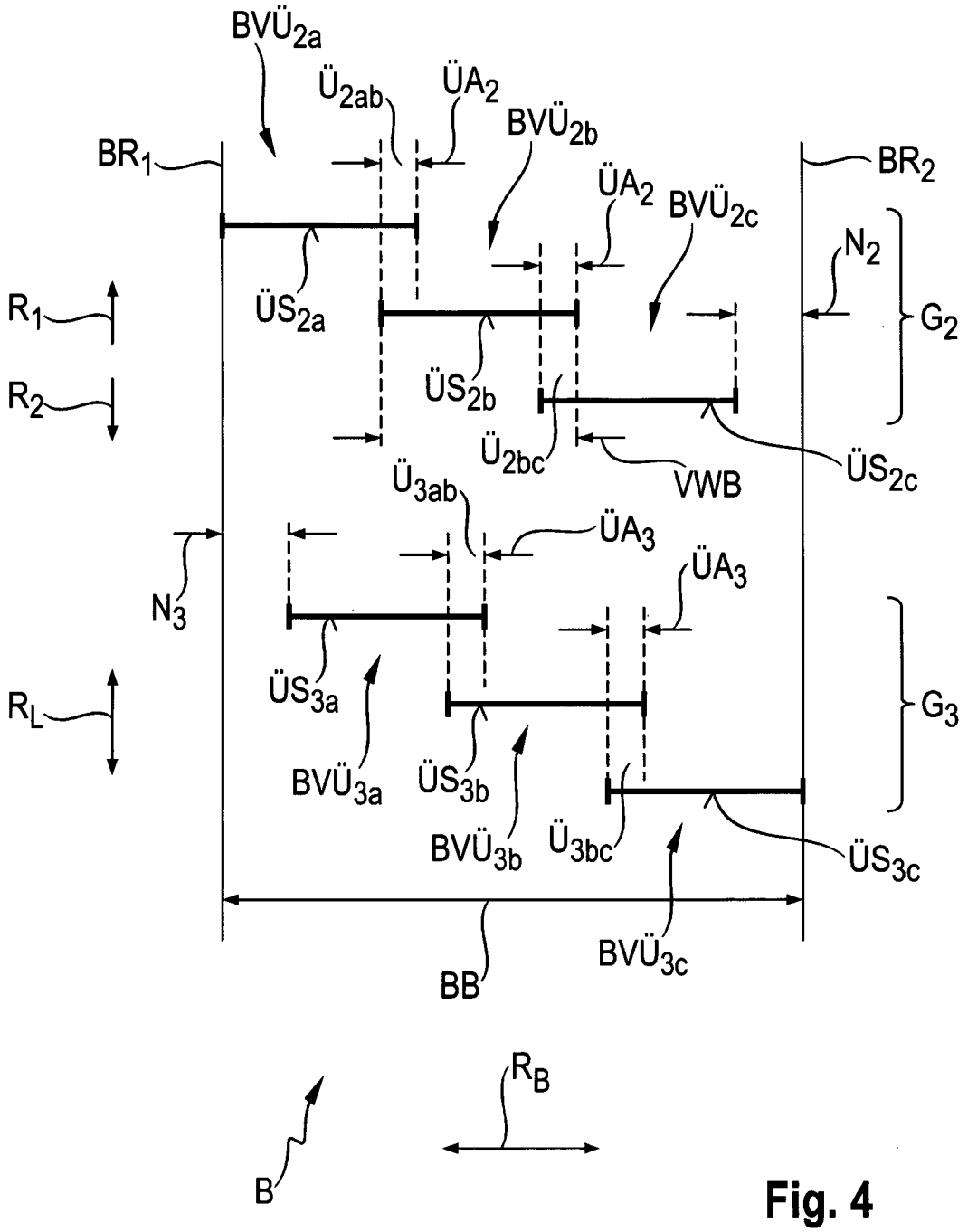
FIG. 4 is a depiction corresponding to FIG. 3 with two groups of compactor passes, neither of which entirely covers the base region to be compacted in the direction of the base region width.

FIG. 4 shows two alternatively defined groups $G_2$ and $G_3$ of compactor passes BVÜ. Each of these two groups $G_2$ and $G_3$ has one fewer compacting path ÜS and/or compactor pass BVÜ than the first group $G_1$ of compactor passes. For example, the second group $G_2$ of compactor passes BVÜ has three compactor passes $BVÜ_{2a}$, $BVÜ_{2b}$, and $BVÜ_{2c}$, each with one compacting path $ÜS_{2a}$, $ÜS_{2b}$, and $ÜS_{2c}$. The compacting path $ÜS_{2a}$ visible in the left of FIG. 4 is defined such that it is located either essentially exactly, or with some overhang along the edge region $BR_1$. The individual compacting paths $ÜS_{2a}$, $ÜS_{2b}$, and $ÜS_{2c}$ overlap one other with an amount of overlap $ÜA_2$ which can be selected such that it corresponds to a minimum amount of overlap, but at least is not smaller. The minimum amount of overlap can be specified, for example, such that with allowance for the unavoidable imprecision in the advancing movement of a compactor, a condition in which adjacent passes no longer overlap one another or have an non-compacted area between them is avoided.

In the second group $G_2$, it is evident for example that under the proviso that the amount of overlap $ÜA_2$ is in the vicinity of the minimum amount of overlap, the three specified compactor passes $BVÜ_{2a}$, $BVÜ_{2b}$, and $BVÜ_{2c}$ cannot cover the total width of base region BB of the base region B to be compacted. A non-rolled edge strip $N_2$ remains.

The third group $G_3$ of compactor passes BVÜ likewise has three compactor passes $BVÜ_{3a}$, $BVÜ_{3b}$, and $BVÜ_{3c}$, with compacting paths $ÜS_{3a}$, $ÜS_{3b}$, and $ÜS_{3c}$ respectively. The compactor passes BVU of the third group $G_3$ are configured such that the compacting path $ÜS_{3c}$ of the compactor pass $BVÜ_{3c}$ shown in the far right in FIG. 4 or close to the edge region $BR_2$, runs either substantially exactly or with an overhang along this edge region $BR_2$.

The amount of overlap $ÜA_3$ provided in this third group $G_3$ of compactor passes BVÜ can also be selected at or near a minimum amount of overlap, in order to cover the largest possible surface area in the base region width direction $R_B$ with the three defined compactor passes $BVÜ_{3a}$, $BVÜ_{3b}$ and $BVÜ_{3c}$. Nonetheless here too there is an edge strip $N_3$ in which the base region B is not rolled in the third group $G_3$ of compactor passes in the base region width direction BB and is thus not compacted.

For example, the positioning of the second group $G_2$ of compactor passes BVÜ in a base region B is depicted in a top view in FIG. 2. One can identify the compacting path $ÜS_{2a}$ defined along the edge region $BR_1$, as well as the area $N_2$ formed between the compacting path $ÜS_{2c}$ and the second edge region $BR_2$ and not covered by this second group $G_2$ of compactor passes BVÜ. Also evident are the overlap areas $Ü_{2ab}$ and $Ü_{2bc}$ between the compacting paths $ÜS_{2a}$ and $ÜS_{2b}$ on the one hand, and the compacting paths $ÜS_{2b}$ and $ÜS_{2c}$ on the other.

If necessary, several such groups $G_1$, $G_2$, and $G_3$ can be laid one over the other to prepare a compacting plan, that is, they can be executed one after the other. For example, the sequence could be such that first the group $G_1$ is executed, then group $G_2$, and then group $G_3$. The result will be that, disregarding the overlap areas $Ü_{1ab}$, $Ü_{1bc}$, $Ü_{1cd}$, $Ü_{2ab}$, $Ü_{2bc}$, $Ü_{3ab}$, and $Ü_{3bc}$ between adjacent compacting paths ÜS, in the base region width direction BB nearly every surface area of base region B is covered by three passes. If one also considers that in each of the groups $G_1$, $G_2$, $G_3$, the overlap areas $Ü_{1ab}$, $Ü_{1bc}$, $Ü_{1cd}$, $Ü_{2ab}$, $Ü_{2bc}$, $Ü_{3ab}$, and $Ü_{3bc}$ are present, in which a double pass occurs, and if one further considers—as a comparison of FIGS. 3 and 4 clearly shows—that the overlap areas $Ü_{1ab}$, $Ü_{1bc}$, $Ü_{1cd}$, $Ü_{2ab}$, $Ü_{2bc}$, $Ü_{3ab}$, and $Ü_{3bc}$ formed in the various groups $G_1$, $G_2$, $G_3$ are each offset to each other in the width direction $R_B$, this leads to a compacting plan in which, in addition to the three compactor passes per surface unit discussed above, for nearly all surface areas an additional compactor pass occurs owing to the totality of the overlap areas $Ü_{1ab}$, $Ü_{1bc}$, $Ü_{1cd}$, $Ü_{2ab}$, $Ü_{2bc}$, $Ü_{3ab}$, and $Ü_{3bc}$, so that after execution of the three groups $G_1$, $G_2$, and $G_3$, a larger surface area of the base region B is compacted by four compactor passes BVÜ, whereas in particular near the edge regions BR1 and BR2 a smaller number of compactor passes occur, and likewise in a few intermediate regions, which are not covered by overlap areas $Ü_{1ab}$, $Ü_{1bc}$, $Ü_{1cd}$, $Ü_{2ab}$, $Ü_{2bc}$, $Ü_{3ab}$, and $Ü_{3bc}$. But basically very uniform processing or compacting of the material M in the base region B is obtained.

Figure 5:
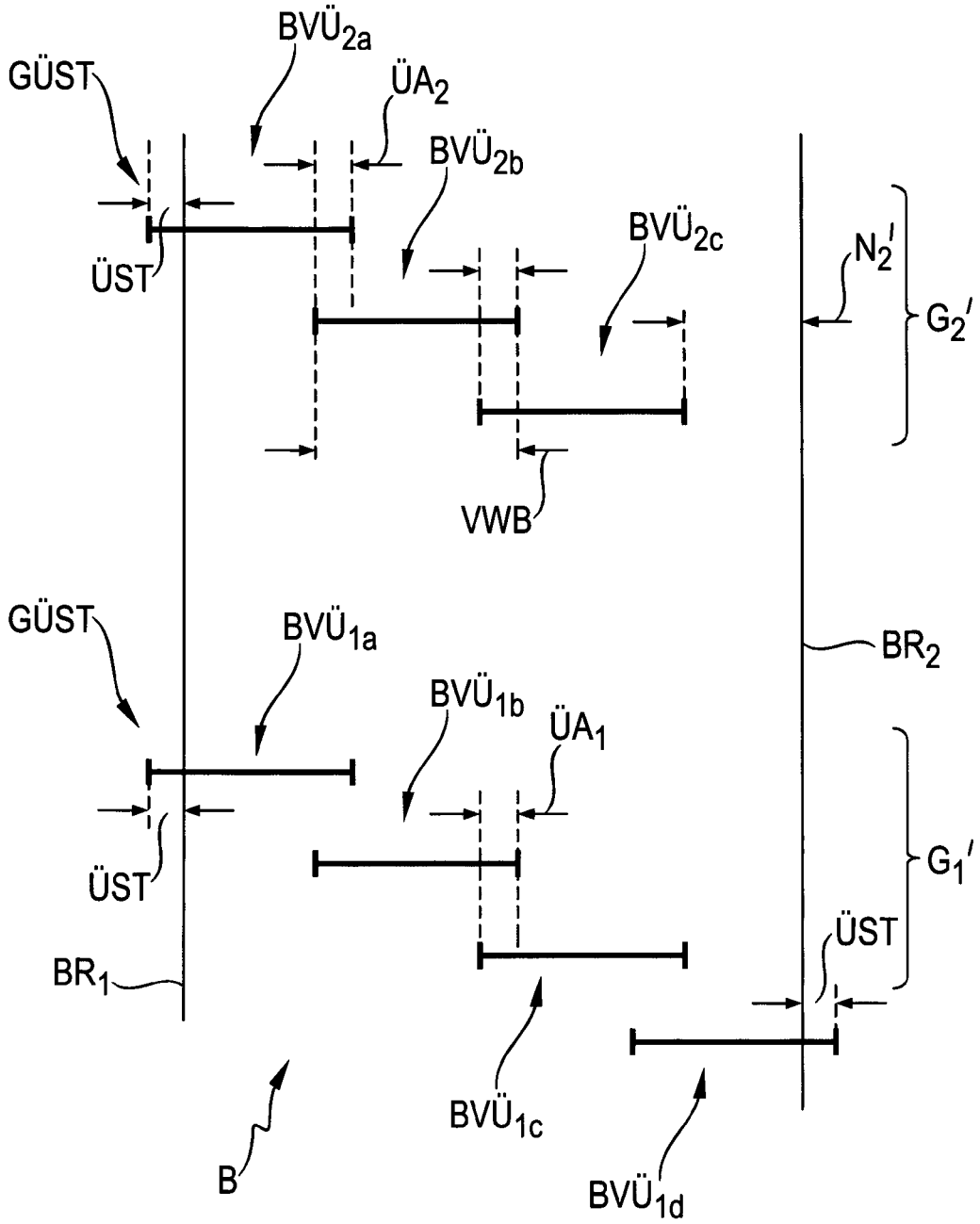
FIG. 5 is a depiction according to FIGS. 3 and 4 with overhang in the edge region.

Based on two groups $G_2'$ and $G_1'$ of compactor passes BVÜ, FIG. 5 shows the provision of an overhang ÜST in one or in both edge regions $BR_1$ and $BR_2$ of base region B. This overhang can be chosen such that with allowance for the unavoidable movement imprecision when driving a compactor, the entire surface in base region B is covered, even to the particular edge area $BR_1$ or $BR_2$, in one group of compactor passes. For example, the overhang could be selected such that it corresponds to the minimum amount of overlap.

With respect to group $G_2'$, which otherwise corresponds to the group $G_2$, it is evident that the compactor pass $BVÜ_{2a}$ on the far left, that is, near the edge region $BR_1$, extends laterally over the edge region $BR_1$ with an overhang ÜST which is defined here by the total overhang GÜST. The result is that the otherwise equally formed group $G_2'$ of compactor passes BVÜ is shifted to the left, that is, in the direction of edge region $BR_1$. The result of this is that the uncovered edge area $N_2'$ is larger than in the case when the compactor pass $BVÜ_{2a}$ runs as precisely as possible along the edge region $BR_1$ without the overhang ÜST.

With regard to group $G_1'$, which is also depicted in FIG. 5 and which otherwise basically corresponds to the group $G_1$ and has a number of compactor passes BVÜ such that they can cover the entire width area of the base region B, the two compactor passes $BVÜ_{1a}$ and $BVÜ_{1d}$ are defined such that they each overlap the assigned edge region $BR_1$ or $BR_2$ respectively with an overhang ÜST. Here too, the particular overhang ÜST can be selected such that it corresponds to the minimum amount of overlap. Thus a total overhang GÜST is formed, which thus substantially corresponds to 2 times the overhang ÜST present at one particular edge region $BR_1$ and/or $BR_2$, and thus for example also corresponds to 2 times the minimum amount of overlap. The result of providing this total overhang GÜST is that the amount of overlap $ÜA_1$ occurring in the particular overlap areas is less than in the case of group $G_1$ of FIG. 3, in which the compactor passes $BVÜ_{1a}$ and $BVÜ_{1d}$ are defined essentially with no overhang along the edge regions $BR_1$ and $BR_2$. In calculating the particular amount of overlap in one group—depending on whether an overhang ÜST is provided or not—this quantity can be set either to zero, namely when essentially no overhang is used, or its specific value can be allowed for, namely when a particular value of overhang is to be used.

As already disclosed above, in accordance with the asphalt model cited above, the number of compactor passes and/or of the individual passes referred to the compactor rollers can be specified and then combined into a compacting plan through the corresponding overlay of said groups of compactor passes. In this context it is self-evident that the compactor passes or groups of compactor passes combined into one such compacting plan can be positioned or configured differently than depicted in FIGS. 3, 4, and 5. For example, one group of compactor passes could be selected in which none of the compacting paths runs directly along an edge region $BR_1$ and/or $BR_2$. Furthermore, obviously one or a number of these groups could be multiply provided in a compacting plan, wherein advantageously a group defined with a different location of compacting paths lies between a multiply repeated group of compactor passes in order to ensure that the overlap areas formed after two directly sequential passes do not lie exactly on the same surface area of the base region.

After preparation of this kind of compacting plan with the corresponding definition of the location of the compacting paths in the base region B to be processed, this plan can be converted into a geodata model. This means that the initially abstract compacting paths ÜS running in the base region B are converted into geodata which describe the actual course of a particular compacting path in space. These data can then be transmitted to the specific compactor that is to be used, so that the potential is created in the compactor itself to move it along the compacting paths now present in geodata. This can be implemented fully automatically, for example in that, by allowing for the GPS signals received over the radio receiver 28 and comparing the geodata of a particular compacting path stored in the compactor 10, the compactor 10 is steered automatically with no significant interaction required on the part of the operator. In an alternative procedure, the course of compacting paths could be displayed on the display 26, just as the position of the compactor 10 or its path, so that an operator 10 is able to move the compactor 10 along the compacting path indicated on the display 26 with the smallest possible deviation. In this regard the course of movement of the compactor 10 can then be recorded and maintained as backup data so as to check subsequently that the compactor 10 was in fact moved with the necessary precision along the compacting paths specified in the compacting plan. Of course, data can also be stored that further specifies the completed compacting process, for example data relating to the compacting mode of a specific compactor or even possible errors, for example the failure of a system needed for setting a compactor mode, such as a vibration mechanism or an oscillation mechanism.

The entity preparing the compacting plan, for example, the central station optionally receiving data regarding the course of the edge regions, need not necessarily be separated from a compactor employed for soil compaction. For example, it can also be located on a compactor and can use the information generated by conversion of the particular compacting paths into geodata to guide a compactor along a particular, defined compacting path, or to display relevant information. Furthermore, it is also possible that such a central station provided on a compactor also communicates with other compactors operating in this or in another base region being compacted, in order to transmit the geodata to them regarding the compacting paths necessary for a particular compacting step based on the compacting plans prepared for the particular compactor.

The invention claimed is:

1. A method for planning and implementation of a compacting process for building a road, by means of at least one compactor, comprising the following steps:

a) defining a base region to be compacted, wherein the base region is defined between two edge regions extending in a base region longitudinal direction of the road and wherein at least one of said edge regions is determined by an asphalt finisher applying asphalt material to be compacted by at least one compactor onto the base region while moving the asphalt finisher along the base region to be compacted in the base region longitudinal direction and thereby prepares it preparing the base region;

b) based on the base region defined in step a), defining a compacting plan with quantity and course of compactor passes in the base region, wherein at least a portion of compacting passes are defined to extend in the base region longitudinal direction;

wherein, in association with at least one of the edge regions, at least one of the compactor passes is defined such as to extend flush or overlapping with and along this edge region, and c) moving the at least one compactor in the base region defined in step a) according to the compacting plan defined in step b).

2. The method according to claim 1, wherein step a) further comprises specification of at least one compactor to be employed for compacting the base region and that in step b), the compacting plan is also defined on the basis of the at least one compactor to be employed for compacting.

3. The method according to claim 2, wherein at least one compactor to be employed for compacting of the base region is selected from a group of compactors which differ in at least one of the following parameters:

Compactor roller width,

Compactor weight,

Compacting mode, and

Crab steering capability.

4. The method according to claim 1, wherein the base region to be compacted is defined in step a) with respect to a base region width.

5. The method according to claim 4, wherein in step b), the compacting plan is defined with at least one group of compactor passes, wherein at least one group of compactor passes comprises a plurality of adjacent compactor passes in the base region width direction, and wherein at least two adjacent compactor passes have mutually overlapping compacting paths.

6. The method according to claim 5, wherein in at least one group of compactor passes, all adjacent compacting paths each have a substantially equal amount of overlap.

7. The method according to claim 5, wherein for at least one group of compactor passes, the adjacent compacting paths have a different amount of overlap with respect to at least one other group of compactor passes.

8. The method according to claim 5, wherein at least two groups of compactor passes are defined with different numbers of compactor passes and/or with different positions of the compacting paths.

9. The method according to claim 5, wherein for at least one group of compactor passes, at least one compacting path is defined substantially flush along an edge region of the base region to be compacted.

10. The method according to claim 9, wherein for at least one group of compactor passes, one compacting path is defined substantially flush along a first edge region, and an additional compacting path is defined substantially flush along a second edge region of the base region to be compacted, and that for at least one group of compactor passes a compacting path is defined substantially flush along the first edge region, and/or for at least one group of compactor passes one compacting path is defined substantially flush along the second edge region.

11. The method according to claim 3, wherein the base region to be compacted is defined in step a) with respect to a base region width; and wherein in step b) a minimum number of compactor passes is determined on the basis of the width of the base region, the width of the compactor roller, and a minimum amount of overlap of adjacent compacting paths.

12. The method according to claim 11, wherein the minimum number of compactor passes (n) is determined such that the following relation is substantially satisfied:

$$BB-(VWB-MCA)5n\times VWB-(n-1)\times MCA-GUST<BB,$$

wherein:

n is the minimum number of compactor passes and is a whole integer,

BB is the width of the base region,

VWB is the width of the compactor roller, MUA is the minimum amount of overlap, GUST is the total edge overhang.

13. The method according to claim 3 wherein the base region to be compacted is defined in step a) with respect to a base region width; and wherein in step b) a maximum number of compactor passes is determined on the basis of the width of the base region, the width of the compactor roller, and the minimum amount of overlap of adjacent compacting paths.

14. The method according to claim 13, wherein the maximum number of compactor passes (N) is determined such that the following relation is substantially satisfied:

$$BB<N\times VWB-(N-1)\times MCA-GUST<BB+VWB,$$

wherein:

N is the maximum number of compactor passes and is a whole integer,

BB is the width of the base region,

VWB is the width of the compactor roller,

MUA is the minimum amount of overlap,

GUST is the total edge overhang.

15. The method according to claim 12, wherein the base region to be compacted is defined in step a) with respect to a base region width;

wherein that in step b) a maximum number of compactor passes is determined on the basis of the width of the base region, the width of the compactor roller, and the minimum amount of overlap of adjacent compacting paths;

wherein the maximum number of compactor passes (N) is determined such that the following relation is substantially satisfied:

$$BB<N\times VWB-(N-1)\times WA-GUST<BB+VWB,$$

wherein:

N is the maximum number of compactor passes and is a whole integer,

BB is the width of the base region,

VWB is the width of the compactor roller,

MUA is the minimum amount of overlap,

GUST is the total edge overhang;

wherein the following relation applies:

$$N=n+1.$$

16. The method according to claim 14, wherein for one group of compactor passes with a maximum compactor pass number, one compacting path is defined substantially flush along a first edge region and an additional compacting path is defined substantially flush along a second edge region of the base region to be compacted, and that the amount of overlap of adjacent compacting paths of this group of compactor passes is determined such that the following relation substantially applies:

$$BB+GUST=N\times VWB-(N-1)\times UA,$$

wherein:

UA is the amount of overlap,

GUST is the total edge overhang.

17. The method according to claim 10, wherein at least one compactor pass comprises a movement of at least one compactor used for compacting the base region moved forward in a first movement direction and back in a second movement direction opposite to the first movement direction.

* * * * *